US007128770B2

(12) United States Patent
Oh et al.

(10) Patent No.: US 7,128,770 B2
(45) Date of Patent: Oct. 31, 2006

(54) CYCLONE DUST-COLLECTOR

(75) Inventors: Jang-Keun Oh, Gwangju (KR); Jung-Gyun Han, Busan (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 94 days.

(21) Appl. No.: 10/853,392

(22) Filed: May 25, 2004

(65) Prior Publication Data

US 2005/0172584 A1 Aug. 11, 2005

(30) Foreign Application Priority Data

Feb. 11, 2004 (KR) ..... 10-2004-0009092

(51) Int. Cl.
*B01D 45/12* (2006.01)

(52) U.S. Cl. ..... 55/343; 55/346; 55/349; 55/429

(58) Field of Classification Search ..... 55/343, 55/346, 348, 349, 429, 459.1
See application file for complete search history.

(56) References Cited

U.S. PATENT DOCUMENTS 3,769,781 A * 11/1973 Klein et al. ..... 96/372
6,607,572 B1 8/2003 Gammack et al. ..... 55/343
2005/0172586 A1* 8/2005 Oh et al. ..... 55/345
2005/0251951 A1* 11/2005 Oh et al. ..... 15/353

FOREIGN PATENT DOCUMENTS

WO WO 02/067750 9/2002

OTHER PUBLICATIONS

Great Britain Search Report dated Nov. 17, 2004.
Australian Search report dated Feb. 3, 2006 in connection with corresponding Australian Application No. 2004202434.

* cited by examiner

*Primary Examiner*—Robert A. Hopkins
(74) *Attorney, Agent, or Firm*—Ohlandt, Greeley, Ruggiero & Perle, L.L.P.

(57) ABSTRACT

A cyclone dust-collector which filters out dust and dirt from drawn-in air at least two times, comprising a multiple cyclone unit having a first cyclone and a plurality of second cyclones arranged at the outside of the first cyclone, for centrifugally separating the dust and dirt from the drawn-in air; a cover unit connected to the upper portion of the multiple cyclone unit, for allowing the first and the second cyclones to separating communicate with each other; and a dirt-collecting unit connected to the lower portion of the multiple cyclone unit, for collecting therein the dust and dirt centrifugally separated.

12 Claims, 6 Drawing Sheets

CYCLONE DUST-COLLECTOR

REFERENCE TO RELATED APPLICATIONS

This application claims the benefit of Korean Patent Application No. 2004-09092, filed on Feb. 11, 2004, in the Korean Intellectual Property Office, the disclosure of which is incorporated herein by reference in its entirety.

BACKGROUND OF THE INVENTION

1. Field of the Invention

The present invention relates to a vacuum cleaner, and more particularly, to a cyclone dust-collector which centrifugally separates dust and dirt from drawn-in air and collects the dust and dirt.

2. Description of the Related Art

Generally, an up-right type or canister-type vacuum cleaner comprises a suction brush which is connected to a cleaner body and travels along a cleaning surface. The inside of the cleaner body is divided into a dust-collecting chamber in which a dust filter is detachably mounted and a motor-driving chamber in which a motor for providing a suction force is mounted. As the motor is driven, a suction force is generated at the suction brush. Due to the suction force, the air containing dust and dirt is drawn into the cleaner body from the cleaning surface. The drawn-in air is discharged after passing through the dust filter mounted in the dust-collecting chamber of the cleaner body. The various dust and dirt entrained in the air are separated from the air and collected at the dust filter, and the dust and dirt-free air is discharged to the outside via the motor driving chamber.

However, the general vacuum cleaner with the above construction has to have a consumable dust filter to separate and collect the dust and dirt.

Also, the dust filter has to be periodically replaced with a new one when it is full of the dust and dirt. For the replacement, a user directly touches the dust filter with his or her hands, which causes a problem of inconvenience or is injurious to the health of the user.

In an attempt to solve these problems, a cyclone dust-collector which provides a high dust collection efficiency and can be semi-permanently used after removing the filtered-out dirt, has been proposed and is being now widely used. The cyclone dust-collecting apparatus separates and collects dust and dirt from the air by a centrifugal effect.

However, the cyclone dust-collector adopts a semi-permanent cyclone dust-collecting construction instead of using a conventional dust bag or a dust filter. Therefore, the dust collection efficiency depends on the construction or performance of the cyclone dust-collector, so there may be an occasion where the cyclone dust-collector lets fine particles pass without filtering them completely. Accordingly, there is a need for a cyclone dust-collector that is capable of separating and collecting fine particles efficiently.

SUMMARY OF THE INVENTION

The present invention has been developed in order to solve the aforementioned problems. Accordingly, an aspect of the present invention is to provide a cyclone dust-collector having an improved construction which is capable of separating and collecting the fine particles efficiently.

The above aspect is achieved by providing a cyclone dust-collector which filters out dust and dirt from drawn-in air at least two times. The cyclone dust-collector comprises a multiple cyclone unit having a first cyclone and a plurality of second cyclones arranged at the outside of the first cyclone, for centrifugally separating the dust and dirt from the drawn-in air, a cover unit connected to the upper portion of the multiple cyclone unit, for allowing the first and the second cyclones to fluidly communicate with each other; and a dirt-collecting unit connected to the lower portion of the multiple cyclone unit, for collecting therein the dust and dirt centrifugally separated.

The first cyclone may comprise a suction port through which the dirt-laden air is drawn in, an inner case having a cylindrical shape and connected to the suction port, a grill disposed inside the inner case, and an air discharge outlet disposed at an upper end of the inner case and connected to the grill.

The suction port may have at least one part having a substantially dome shape cross-section.

The first cyclone may further comprise an air guide wall connected to the suction port, for fluidly communicating the air discharge outlet with the inner wall of the inner case.

The air guide wall may be gradually inclined downwardly in a spiral direction.

The grill may comprise a cylindrical body having a plurality of perforations, and a skirt extending from the lower end of the body and having a cutout part which is cut out therefrom in a circumferential direction.

The skirt may have an inclined surface which is downwardly inclined toward the cutout part in a circumferential direction.

The second cyclone may comprises an outer case enclosing the outer circumference of the first cyclone, and a funnel-shaped member formed between the outer case and the first cyclone, and having an upper end and a lower end opened, wherein through the opened upper and lower ends, the dir-laden air enters from the cover unit to the funnel-shaped member and the cleaned air exits from the funnel-shaped member.

A plurality of the funnel-shaped members may be arranged along a circumferential direction in a predetermined pattern, forming a multiple cyclone unit.

The plurality of funnel-shaped members may be arranged at the outside of the first cyclone except for a predetermined space at a predetermined interval.

The first and the second cyclones may be integrally formed with each other.

The cover unit may comprise a first cover connected to the upper portion of the multiple cyclone unit, and having centrifugal passages for guiding the air discharged from the first cyclone to be a vortex toward the second cyclones, and discharge holes, and a second cover covering the upper portion of the first cover, and having a discharge port through which air existing from the discharge holes is exhausted.

The dirt-collecting unit may comprise a main receptacle connected to the lower portion of the second cyclone, and a partition member disposed in the main receptacle to divide the main receptacle to a first and a second spaces, wherein relatively large dirt separated by the first cyclone is collected on the first space, and relatively small dirt separated by the second cyclones is collected on the second space.

BRIEF DESCRIPTION OF THE DRAWINGS

The above aspect and other advantages of the present invention will be more apparent by describing an embodiment of the present invention in detail with reference to the accompanying drawings, in which.

DETAILED DESCRIPTIONS OF THE EXEMPLARY EMBODIMENTS

Hereinafter, a cyclone dust-collector according to the embodiment of the present invention will be described in detail with reference to the accompanying drawings.

Figure 1:
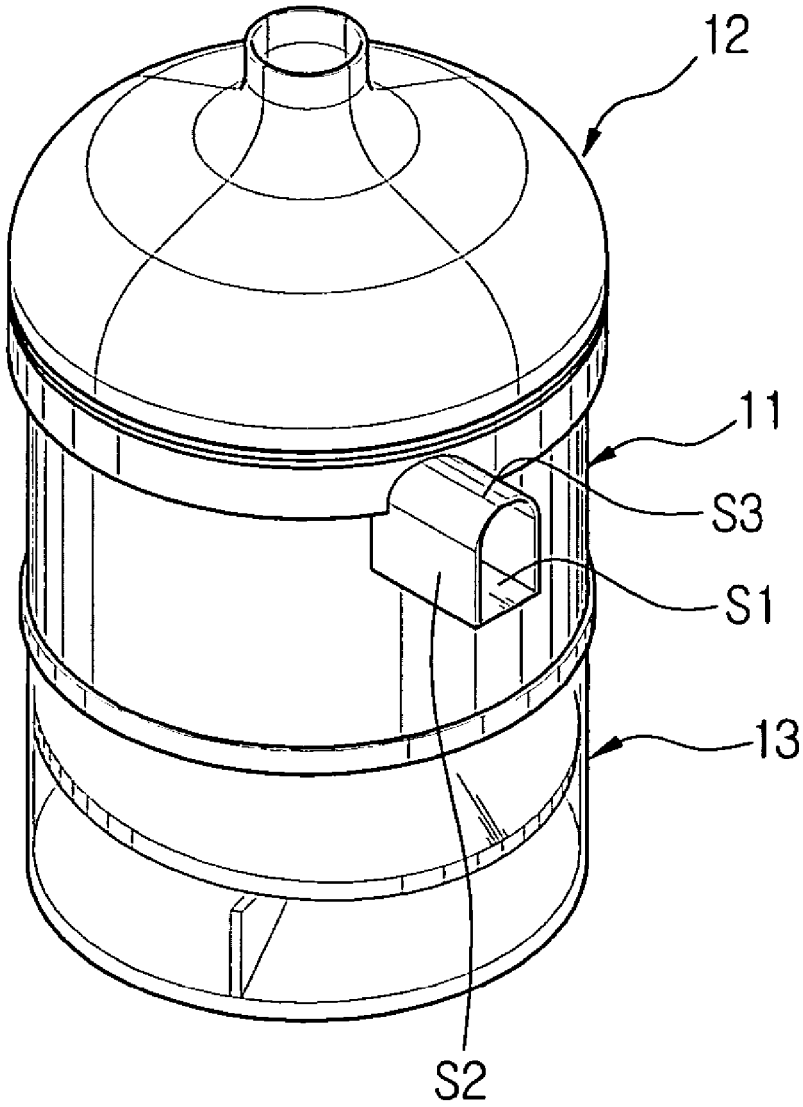
FIG. 1 is a perspective view showing a cyclone dust-collector according to an embodiment of the present invention.

FIG. 1 is a perspective view showing a cyclone dust collector according to an embodiment of the present invention. Referring to FIG. 1, the cyclone dust-collector comprises a multiple cyclone unit 11, a cover unit 12 connected to the upper portion of the multiple cyclone unit 11, and a dirt-collecting unit 13 connected to the lower portion of the multiple cyclone unit 11.

Figure 2:
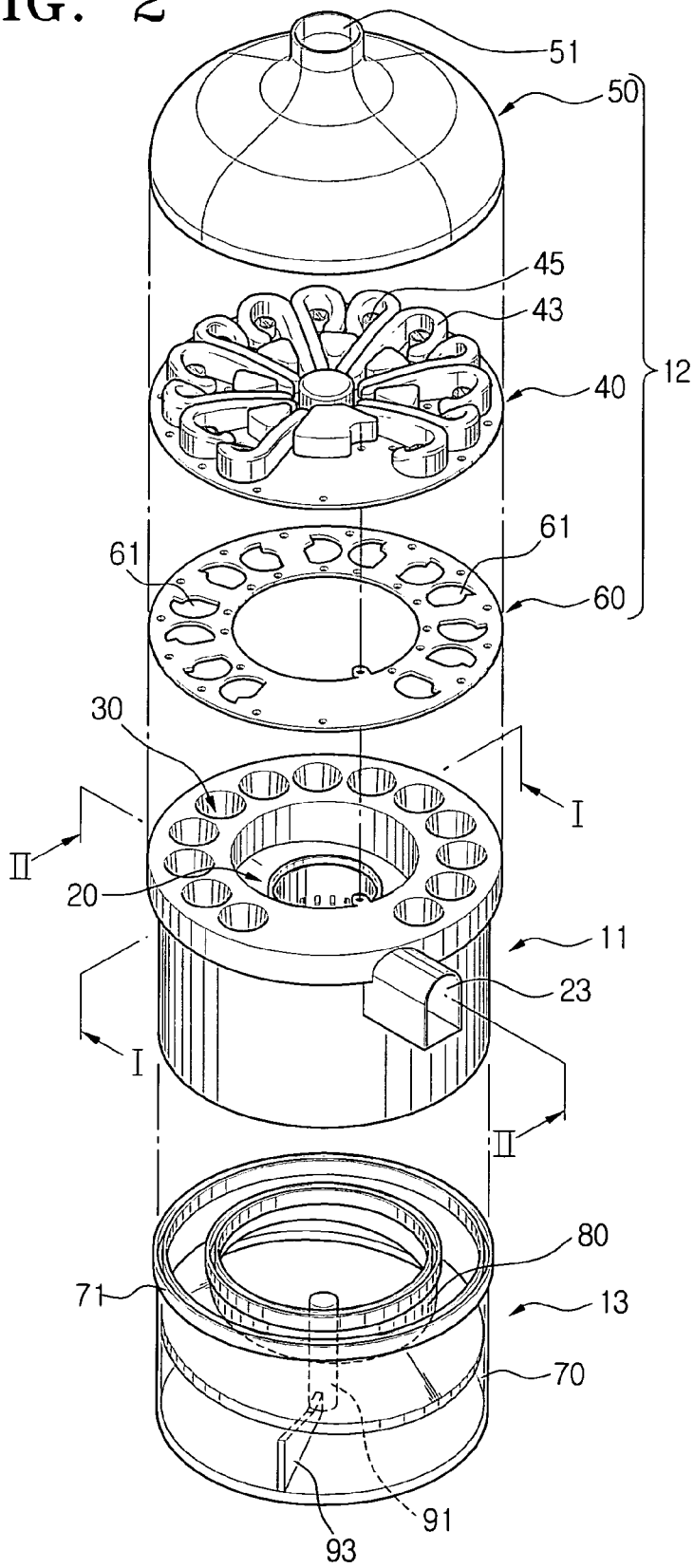
FIG. 2 is an exploded perspective view of the cyclone dust collector of FIG. 1.
Figure 3:
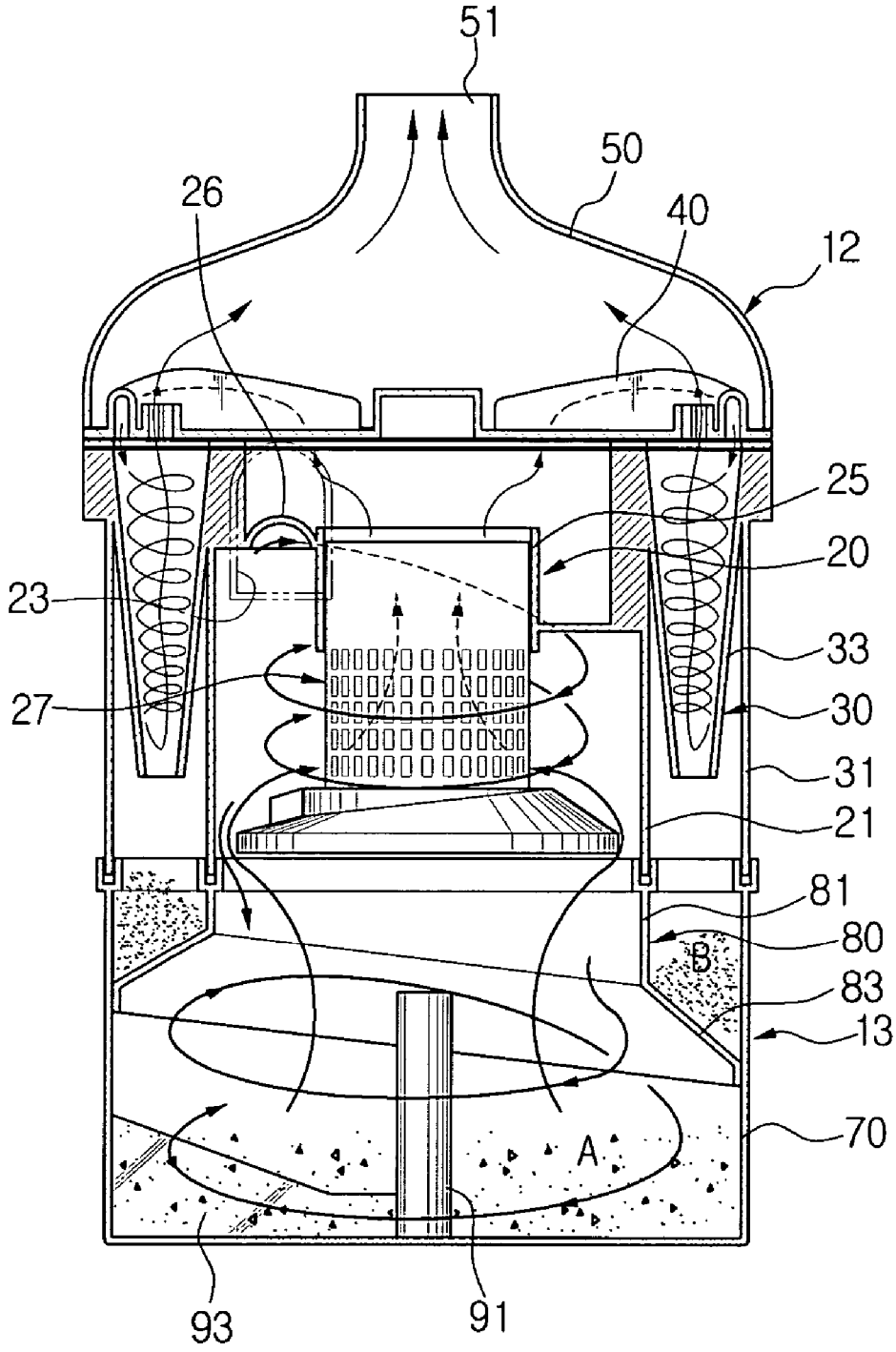
FIG. 3 is a cross-sectional view of the multiple cyclone unit of FIG. 2 across line I—I.
Figure 4:
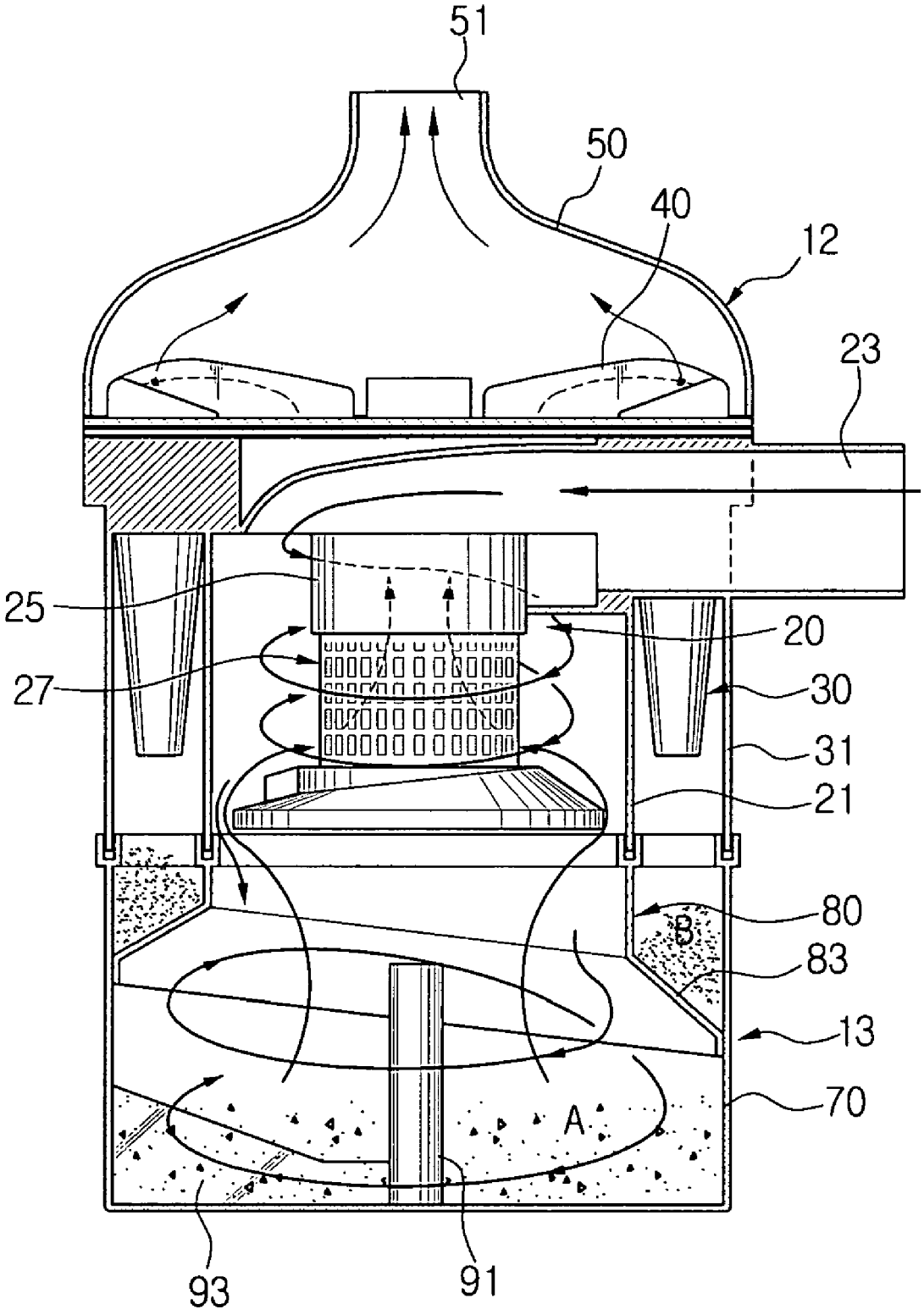
FIG. 4 is a cross-sectional view of the multiple cyclone unit of FIG. 2 across line II—II.

Referring to FIGS. 2 to 4, the multiple cyclone unit 11 comprises a first cyclone 20 and a plurality of second cyclones 30 which are arranged at the outside of the first cyclone 20.

The first cyclone 20 comprises an inner case 21 having a substantially cylindrical shape, a suction port 23 for drawing the air into the inner case 21 therethrough, and a grill 27 connected to an air discharge outlet 25 of the inner case 21. The inner case 21 is integrally formed with an outer case 31 which will be described later. The inner case 21 has an open lower end, and an upper end of the inner case 21 is opened through the air discharge outlet 25. The air discharge outlet 25 is smaller than an inner diameter of the inner case 21. The inside surface of the inner case 21 is fluidly communicated with the air discharge outlet 25 through an air guide wall 26. The air guide wall 26 has a height gradually lowering from the outside of the air discharge outlet 25 in a circumferential direction. For example, the air guide wall 26 extends by a predetermined distance in a spiral direction. The air guide wall 26 is shaped in a dome at the higher portion and shaped in a plane at the lower portion. The dome-shaped portion of the air guide wall 26 is connected to the suction portion 23.

The suction port 23 guides the air containing dust and dirt toward the inner case 21. The suction port 23 is connected from the outside of the outer case 31 to the inner case 21. An inlet 23*a* provided at the outside of the suction port 23 has a substantially anti-circular pipe shape. That is, the inlet 23*a* of the suction portion 23 is comprised of a straight line-shaped lower wall S1, a straight line-shaped vertical wall S2 and a dome-shaped upper wall S3. The upper wall S3 extends to connect to the air guide wall 26. The suction port 23 guides the air drawn in through the inlet 23*a* so that the air is gradually directed to the lower side. Also, the air guide wall 26 guides the drawn-in air to incline in a lower direction, thereby generating a suction force. The dome-shaped portion of the air guide wall 26 as shown in FIG. 3 helps the air drawn in through the suction port 23 to be naturally guided. Especially, because the air is guided along a rounded surface, which is not at an acute angle, the swirling action is minimized so that the suction force becomes strong. As the suction force becomes stronger, the separation efficiency of dirt is increased.

Figure 5:
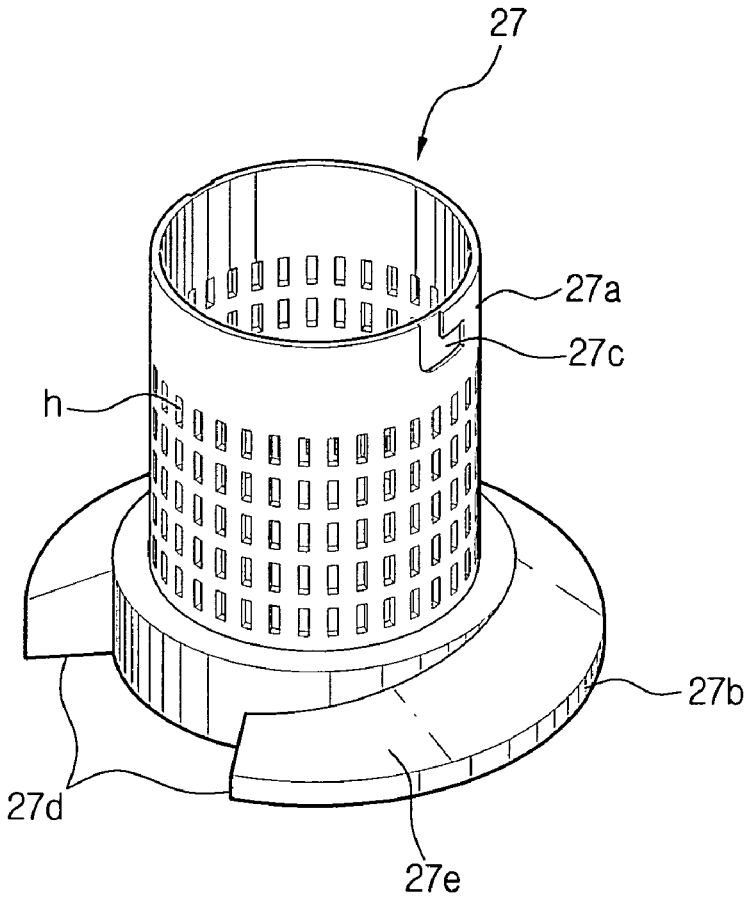
FIG. 5 is a perspective view showing the grill of FIG. 3.
Figure 6:
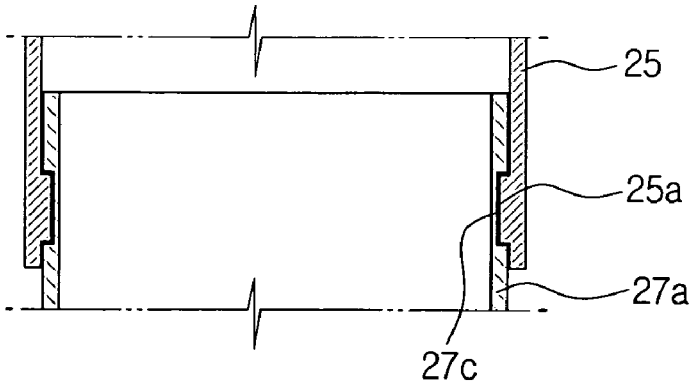
FIG. 6 is a cross-sectional view showing the grill and the air discharge outlet of FIG. 5 in an assembled state.

The grill 27 prevents the relatively large dirt centrifugally separated in the inner case 21 from back flowing and being discharged through the air discharge outlet 25. As shown in FIGS. 5 and 6, the grill 27 has a body 27*a* having a plurality of perforations h defined thereon and a skirt 27*b* connected to the lower end of the body 27*a*. The body 27*a* has an opened upper end and is shaped in a cylinder. The upper end of the body 27*a* is connected to the air discharge outlet 25. For this connection, a connection recess 27*c* is formed in the upper end of the body 27*a*. As shown in FIG. 6, a connection protrusion 25*a* formed on an inner wall of the air discharge outlet 25 is inserted into the connection recess 27*c*. That is, the connection recess 27*c* is connected to the connection protrusion 25*a* in a manner that the body 27*a* is pushed inside the air discharge outlet 25 and is then rotated to a predetermined angle.

The lower end of the body 27*a* is closed and the skirt 27*b* is extended from the outer circumference of the lower end. The skirt 27*b* has an outer diameter smaller than the inner diameter of the inner case 21 but larger than the outer diameter of the body 27*a*. The skirt 27*b* prevents the dirt centrifugally separated in the inner case 21 from back-flowing. The skirt 27*b* has a cutout part 27*d* which is cutout therefrom along the circumferential direction. The cutout part 27*d* lets the dirt larger than a gap between the skirt 27*a* and the inner case 21 drop down. The skirt 27*b* has an inclined surface 27*e* gradually inclining toward the cutout part 27*d* in the circumferential direction. The inclined surface 27*e* becomes lowered toward a centrifugal direction of the air. Accordingly, the dirt falling down on the skirt 27*b* is moved along the inclined surface 27*e* by the centrifugal force ad drops down through the cutout part 27*d*.

A plurality of second cyclones 30 is arranged at the outside of the inner case 21 along the circumferential direction. The plurality of second cyclones 30 use the outer case 31 enclosing the inner case 21 as a common dust-collecting space. Accordingly, each second cyclone 30 is comprised of the outer case 31 and a funnel-shaped member 33. The funnel-shaped member 33 has an upper end and a lower end opened. The air descending from the upper portion of the funnel-shaped member 33 while forming a vortex ascends again and exists from the upper end of the funnel-shaped cyclone 20. During these movements of the air, the fine particles are centrifugally separated from the air and exist from the lower end of the funnel-shaped member 3.

The plurality of second cyclones 30 is referred to a multiple cyclone unit and encloses at least one part of the outside of the first cyclone 20. Referring back to FIG. 2, the second cyclones 30 are arranged at the outside of the first cyclone 20 in the circumferential direction at a predetermined interval. That is, the second cyclones 30 are arranged at the outside of the first cyclone 20 except for the portion where the suction port 23 is formed. The second cyclones 30 are integrally formed with the first cyclone 20. That is, the inner and outer cases 21 and 31, the funnel-shaped member 33 and the suction port 23 are integrally formed with all together.

Figure 7:
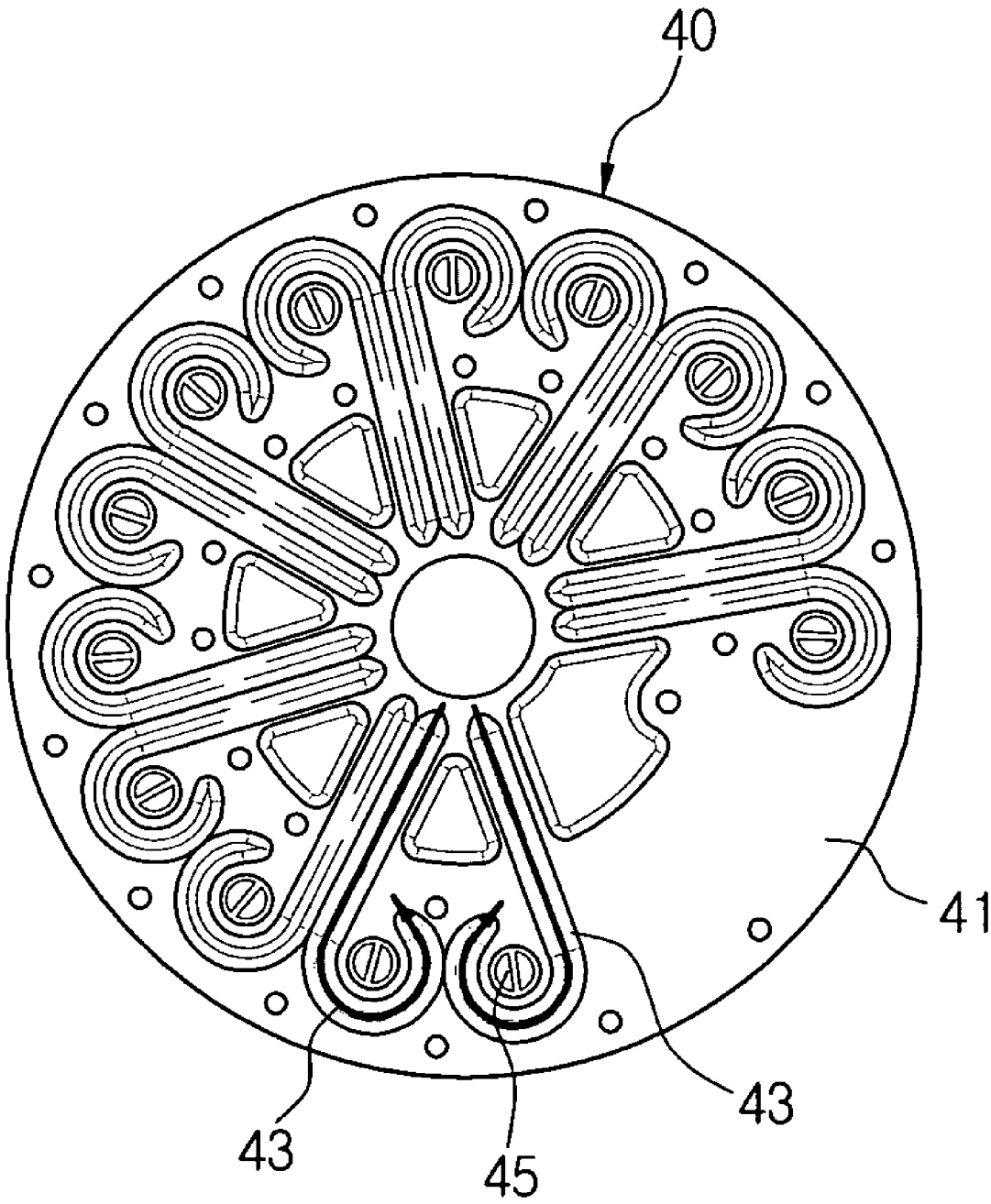
FIG. 7 is a top view showing the cover and plurality of secondary cyclones of FIG. 3.

The cover unit 12 comprises a first cover 40, a second cover 50, and a gasket 60. The first cover 40 guides the air passing from the first cyclone 20 toward the respective second cyclones 30. The first cover 40 is connected to the upper portion of the cyclone unit 11, and the gasket 60 is interposed between the first cover 40 and the cyclone unit 11. As shown in FIG. 7, the first cover 40 comprises a plate-shaped body 41, a plurality of centrifugal passages 43 arranged in a radial direction with respect to the center of the body 41, and discharge holes 45. The centrifugal passages 43 guides the air discharged from the air discharge outlet 25 of the first cyclone 20 to flow in a centrifugal direction of the vortex and move to the upper entrances of the second cyclones 30. That is, the air flowing upward to the center of the body 41 is dispersed in all directions along the centrifugal passages 43, and moves to the second cyclones 30 while forming the vortex. The fine particles-free cleaned air in the funnel-shaped member 33 of the second cyclones 30 ascends and escapes from the second cyclones 30 through the discharge holes 45. The air existing from the discharge holes 45 is discharged to a discharge port 51 of the second cover 50. The second cover 50 is connected to cover the first cover 40 and discharges the air exhausted from the respective discharge holes 45 all together.

The gasket 60 has openings 61 corresponding to the respective second cyclones 30. The plurality of openings 61 are arranged at a predetermined interval to face the discharge holes 45. The openings 61 are shaped in an anti-circle and guide the air existing from the centrifugal passages 43 so as to increase a centrifugal force in the air current.

The dirt-collecting unit 13 is detachably connected to the lower portion of the multiple cyclone unit 12. The dirt-collecting unit 13 has two separate spaces A and B for collecting the relatively large dirt and the fine particles respectively separated by centrifugal effect at the first and the second cyclones 20 and 30. The dirt-collecting unit 13 comprises a main receptacle 70 and a partition member 80 disposed inside the main receptacle 70. The main receptacle 70 has the same outer diameter as that of the outer case 31, and has a connection portion 71 connected to the lower end of the outer case 31. The partition member 80 has a cylindrical body 81 connected to the lower end of the inner case 21 and a skirt 83 extending from the lower end of the body 81 connect to the inside of the main receptacle 70. The first space A formed by the inside portion of the partition member 80 and the lower space of the main receptacle 70 collects therein the relatively larger dirt separated by the first cyclone 20.

The second space B formed between the outside of the partition portion 80 and the upper portion of the main receptacle 70 communicates with the second cyclones 30. Accordingly, the second space B collects therein the fine particles separated by the second cyclones 30. In one embodiment, the main receptacle 70 is made of transparent material to allow a user to check the collection amounts of the dirt from the outside. The skirt 83 of the partition member 80 has one part more inclined downwardly than the other part. Through the more inclined part, the user easily checks the amounts of dirt collected in the second space B from the outside.

Also, a column 91 protrudes from the bottom of the main receptacle 70. The column 91 prevents the dirt collected in the first space A from ascending with a vortex generated in the first space A. In another embodiment, a partition 93 connecting the column 91 and the inner wall of the main receptacle 71 may be further provided. The partition 93 prevents the dirt collected in the main receptacle 70 from rotating and moving by air current.

The operation of the cyclone dust-collector with the above construction according to the present invention will be described in detail hereinbelow.

Referring to FIGS. 3 and 4, the dirt-laden air is drawn in through the suction port 23. The drawn in air is guided by the air guide wall 26, being transformed to a vortex, and flows into the inner case 21. Relatively large dirt is separated from the air by centrifugal effect of the vortex and falls down to the first space A of the main receptacle 70. The large dirt-free air passes through the grill 27 and is discharged out through the air discharge outlet 25. The ascending air collides with the first cover 40 and is dispersed along the centrifugal passages 43 to enter into the respective second cyclones 30. The air is induced to be a vortex due to the shape of the centrifugal passages 43 and is subjected to the second centrifugal separation in the second cyclones 30. The second cyclones 30 separate fine particles from the air, which have not still been separated at the first cyclone 20, and the vortex is discharged toward the second cover 50 through the discharge holes 45 of the first cover 40. The fine particles separated by the second cyclones 30 and falling down are collected on the second space B. The air discharged from the discharge holes 45 of the first cover 40 exists along a predetermined path through the discharge port 51 of the second cover 50. To the discharged port 51 may be directly or indirectly a driving motor for providing the suction force. Also, the driving motor may be connected to the suction port 23.

As described above, the first cyclone 20 having a relatively big capacity separates and collects the relatively large dirt, and the second cyclones 30 separates and collects the relatively small particles which have not still been separated by the first cyclone 20, thereby improving the dirt-collection efficiency. The second cyclones 30 adopt the multiple cyclone type which are arranged at the outside of the first cyclone 20, thereby improving the fine particles collection efficiency.

Although not shown, the cyclone dust-collector having the above construction can be applied to the various cleaners.

The cyclone dust-collector according to the embodiment of the present invention comprises the first and the second cyclones 20 and 30 for sequentially separating the dust and dirt from the air, thereby improving the dust-collection efficiency.

Especially, the plurality of second cyclones 30 are arranged at the outside of the first cyclone 20, forming the multiple cyclone unit, so that the fine particles which have not still been separated at the first cyclone 30 can be efficiently separated.

What is claimed is:

1. A cyclone dust-collector which filters out dust and dirt from drawn-in air at least two times, comprising:

a multiple cyclone unit having a first cyclone and a plurality of second cyclones arranged at the outside of the first cyclone, for centrifugally separating the dust and dirt from the drawn-in air;

a cover unit connected to the upper portion of the multiple cyclone unit, for allowing the first and the second cyclones to fluidly communicate with each other; and a dirt-collecting unit connected to the lower portion of the multiple cyclone unit, for collecting therein the dust and dirt centrifugally separated, wherein the first cyclone comprises:

a suction port through which the dirt-laden air is drawn in;

an inner case having a cylindrical shape and connected to the suction port;

a grill disposed inside the inner case; and an air discharge outlet disposed at an upper end of the inner case and connected to the grill.

2. The cyclone dust-collector as claimed in claim 1, wherein the suction port has at least one part having a substantially dome shape cross-section.

3. The cyclone dust-collector as claimed in claim 1, wherein the first cyclone further comprises an air guide wall connected to the suction port, for fluidly communicating the air discharge outlet with the inner wall of the inner case.

4. The cyclone dust-collector as claimed in claim 3, wherein the air guide wall is gradually inclined downwardly in a spiral direction.

5. The cyclone dust-collector as claimed in claim 1, wherein the grill comprises:

a cylindrical body having a plurality of perforations; and a skirt extending from the lower end of the body and having a cutout part which is cut out therefrom in a circumferential direction.

6. The cyclone dust-collector as claimed in claim 5, wherein the skirt has an inclined surface which is downwardly inclined toward the cutout part in a circumferential direction.

7. The cyclone dust-collector as claimed in claim 1, wherein the first and the second cyclones are integrally formed with each other.

8. A cyclone dust-collector which filters out dust and dirt from drawn-in air at least two times, comprising:

a multiple cyclone unit having a first cyclone and a plurality of second cyclones arranged at the outside of the first cyclone, for centrifugally separating the dust and dirt from the drawn-in air;

a cover unit connected to the upper portion of the multiple cyclone unit, for allowing the first and the second cyclones to fluidly communicate with each other; and a dirt-collecting unit connected to the lower portion of the multiple cyclone unit, for collecting therein the dust and dirt centrifugally separated, wherein the plurality of second cyclones comprise:

an outer case enclosing the outer circumference of the first cyclone; and a plurality of funnel-shaped members formed between the outer case and the first cyclone, each of said plurality of funnel-shaped members having an upper end and a lower end opened, wherein through the opened upper and lower ends, the dirt-laden air enters from the cover unit to the plurality of funnel-shaped members and the cleaned air exits from the plurality of funnel-shaped members.

9. The cyclone dust-collector as claimed in claim 8, wherein a plurality of the funnel-shaped members are arranged along a circumferential direction in a predetermined pattern, forming a multiple cyclone unit.

10. The cyclone dust-collector as claimed in claim 9, wherein the plurality of funnel-shaped members are arranged at the outside of the first cyclone except for a predetermined space at a predetermined interval.

11. A cyclone dust-collector which filters out dust and dirt from drawn-in air at least two times, comprising:

a multiple cyclone unit having a first cyclone and a plurality of second cyclones arranged at the outside of the first cyclone, for centrifucially separating the dust and dirt from the drawn-in air;

a cover unit connected to the upper portion of the multiple cyclone unit, for allowing the first and the second cyclones to fluidly communicate with each other; and a dirt-collecting unit connected to the lower portion of the multiple cyclone unit, for collecting therein the dust and dirt centrifugally separated, wherein the cover unit comprises:

a first cover connected to the upper portion of the multiple cyclone unit, and having centrifugal passages for guiding the air discharged from the first cyclone to be a vortex toward the second cyclones, and discharge holes; and a second cover covering the upper portion of the first cover, and having a discharge port through which air exiting from the discharge holes is exhausted.

12. A cyclone dust-collector which filters out dust and dirt from drawn-in air at least two times, comprising:

a multiple cyclone unit having a first cyclone and a plurality of second cyclones arranged at the outside of the first cyclone, for centrifugally separating the dust and dirt from the drawn-in air;

a cover unit connected to the upper portion of the multiple cyclone unit, for allowing the first and the second cyclones to fluidly communicate with each other; and a dirt-collecting unit connected to the lower portion of the multiple cyclone unit, for collecting therein the dust and dirt centrifugally separated, wherein the dirt-collecting unit comprises:

a main receptacle connected to the lower portion of the second cyclone; and a partition member disposed in the main receptacle to divide the main receptacle to a first and a second spaces, wherein relatively large dirt separated by the first cyclone is collected on the first space, and relatively small dirt separated by the second cyclones is collected on the second space.

* * * * *